US006520593B2

(12) United States Patent
Dvorak et al.

(10) Patent No.: US 6,520,593 B2
(45) Date of Patent: Feb. 18, 2003

(54) HYDRAULIC POSITIONING SYSTEM

(75) Inventors: Paul A. Dvorak, Sanford, NC (US); James Brian Normann, Holly Springs, NC (US); Alessandro Magliulo, Morrisville, NC (US); Michael S. Sekulich, Coats, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/805,393

(22) Filed: Mar. 13, 2001

(65) Prior Publication Data

US 2002/0130547 A1 Sep. 19, 2002

(51) Int. Cl.[7] ..... E01C 23/09
(52) U.S. Cl. ..... 299/39.5; 91/517
(58) Field of Search ..... 91/511, 517; 60/426; 299/39.5, 39.4, 39.6, 73, 75, 76

(56) References Cited

U.S. PATENT DOCUMENTS

| | | | | | |
|---|---|---|---|---|---|
| 2,905,441 | A | * | 9/1959 | Poundstone | 173/159 |
| 3,641,876 | A | * | 2/1972 | Wienke | 60/486 |
| 3,705,631 | A | | 12/1972 | Seaberg | |
| 3,774,696 | A | | 11/1973 | Horsch | |
| 3,972,185 | A | | 8/1976 | Medina | |
| 4,039,010 | A | * | 8/1977 | Tucek | 144/336 |
| 4,116,506 | A | * | 9/1978 | Moritomo et al. | 384/518 |
| 4,161,256 | A | | 7/1979 | Seaberg | |
| 4,736,673 | A | | 4/1988 | Harada et al. | |
| 4,802,537 | A | | 2/1989 | Ryerson | |
| 5,125,232 | A | | 6/1992 | Arii et al. | |
| 5,174,190 | A | * | 12/1992 | Ikari | 91/461 |
| 5,299,857 | A | | 4/1994 | Zanetis | |
| 5,307,631 | A | * | 5/1994 | Tatsumi et al. | 60/452 |

* cited by examiner

*Primary Examiner*—David Bagnell
*Assistant Examiner*—John Kreck
(74) *Attorney, Agent, or Firm*—James R Smith

(57) ABSTRACT

In the operation of a work machine attachment of the type utilizing fluid cylinders, it is desirable provide a way to conveniently operate each of the fluid cylinders while locating any hydraulic conduits required to operate the fluid cylinders away from the operator cab. The present invention provides for a hydraulic positioning system for use with a work machine attachment of the type having a frame, a tool, and a plurality of fluid cylinders coupling the tool with the frame. A fluid deflection device is coupled to at least one fluid cylinder and is in fluid communication with an auxiliary hydraulic circuit having a fluid source. A primary hydraulic circuit is in fluid communication with the fluid deflection device and operable to selectively deflect the fluid source of the auxiliary hydraulic circuit to at least one of the fluid cylinders.

11 Claims, 2 Drawing Sheets

HYDRAULIC POSITIONING SYSTEM

TECHNICAL FIELD

This invention relates to a hydraulic positioning system and more particularly to a hydraulic positioning system for selectively positioning a work machine attachment tool.

BACKGROUND ART

It is well known that a work machine, such as a skid steer loader, typically includes an attachment which is coupled to the work machine's hydraulic system. These attachments typically include a tool which oftentimes is movable relative to the attachment's frame. For example, a cold planer includes a rotary drum which oftentimes has laterally shifting, tilting and depth control capability effectuated by the use of a plurality of hydraulic cylinders. Traditionally, user control of the desired hydraulic cylinder consisted of running separate hydraulic lines from each cylinder to separate levers.

One prior art solution can be found in U.S. Pat. No. 5,299,857 issued to C. Christopher Zanetis on Apr. 5, 1994 which teaches the use of electro-hydraulic valves (E-H valves) to selectively control cylinder operation. In this design, a plurality of switch-activated E-H valves are mounted to a manifold located on the attachment's frame and are used to divert hydraulic fluid from the work machine's primary hydraulic lines to one of the secondary hydraulic lines coupling the manifold to a respective hydraulic cylinder. Although this design may be adequate for its intended purpose, the necessity for electronic components may lead to a more expensive and complex attachment then otherwise possible.

The present invention is directed to overcoming one or more of the problems as set forth above.

DISCLOSURE OF THE INVENTION

In one aspect of the present invention, an attachment for a work machine having a primary hydraulic circuit for providing primary hydraulic pressure, and an auxiliary hydraulic circuit for providing auxiliary hydraulic pressure is provided. The attachment includes a frame adapted for coupling with the work machine, a tool coupled with the frame, a plurality of fluid cylinders operable to move the tool relative to the frame, and a fluid diverting device coupling the fluid cylinders to the auxiliary hydraulic circuit and being selectively positionable by the primary hydraulic pressure to divert the auxiliary hydraulic pressure to at least one of the fluid cylinders.

In another aspect of the present invention, a hydraulic positioning system for use with a work machine attachment having a frame and a tool is provided. The hydraulic positioning system includes a plurality of fluid cylinders coupling the tool with the frame, a fluid deflection device coupled to at least one fluid cylinder, an auxiliary hydraulic circuit having a fluid source and being in fluid communication with the fluid deflection device, and a primary hydraulic circuit in fluid communication with the fluid deflection device and operable to selectively deflect the fluid source of said auxiliary hydraulic circuit to at least one fluid cylinder.

In yet another aspect of the present invention, a method of operating a work machine attachment, said attachment including a frame and a tool, is provided. The method includes the steps of: providing at least a first fluid cylinder operatively coupling the tool with the frame; providing a fluid deflection device having a movable fluid deflection portion; coupling the primary hydraulic circuit to the fluid deflection device, the primary hydraulic circuit having a fluid pressure source; coupling the auxiliary hydraulic circuit to the fluid deflection device, the auxiliary hydraulic circuit having a fluid pressure source; and activating the fluid pressure source of the primary hydraulic circuit thereby causing movement of the movable fluid deflection portion so that the first fluid cylinder is in fluid communication with the auxiliary hydraulic circuit.

BEST MODE FOR CARRYING OUT THE INVENTION

Figure 1:
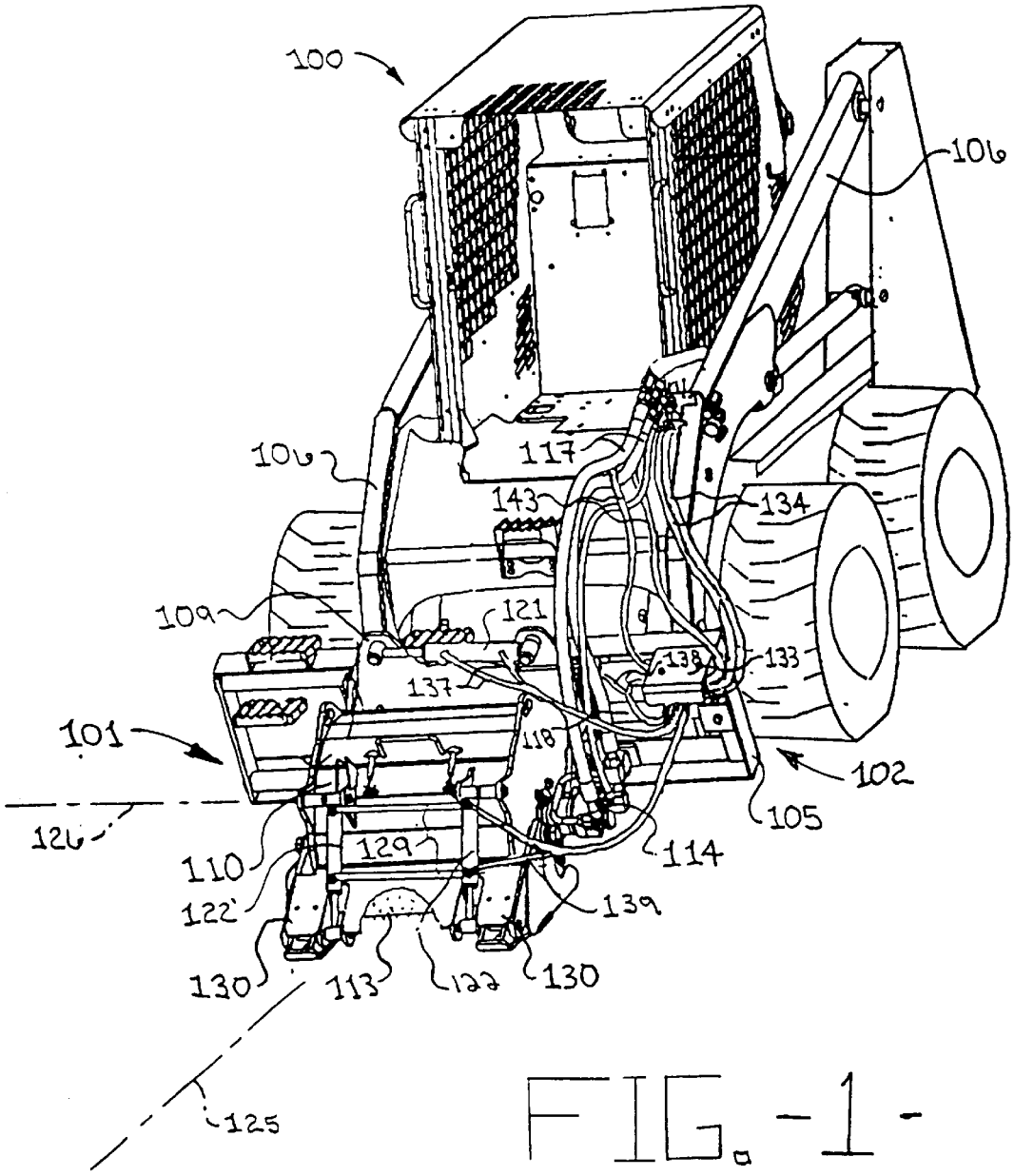
FIG. 1 is a diagrammatic perspective view of a work machine and attachment embodying the principles of the present invention.

With reference to FIG. 1, a work machine 100, such as a skid steer loader, and an attachment 101, such as a cold planer, are shown incorporating the hydraulic positioning system 102 of the present invention. The attachment 101 includes a frame 105 removably attachable in a conventional manner, such as a mechanical quick coupler (not shown), to a pair of lift arms 106. A carrier member 109 is slidably attached to the frame 105 and supports a housing 110 (shown in partial cut-away) used to partially enclose a rotating tool 113. A hydraulic motor 114 rotatably drives the tool 113 and is operated by the work machines hydraulic system via primary hydraulic conduits 117. It is to be understood that the description of the attachment 101 being a cold planer is exemplary only and that it is contemplated that the present invention may also be practiced with, for example, stump grinders, trenchers or other attachments.

The attachment 101 includes a plurality of fluid cylinders, preferably comprising first, second, and third fluid cylinders 118, 121, 122 and 122', which provide the tool 113 with side shift, tilt and depth movement capability, respectively. As used herein, side shift is defined as the ability of the tool to move laterally relative to the frame; tilt is defined as the action of moving the tool 113 about a horizontally arranged longitudinal axis 125 substantially normal with the frame 105; and depth is defined as the action of moving the tool 113 about a horizontally arranged longitudinal axis 126 lying substantially parallel with the frame 105. For the exemplary attachment 101 shown and described herein, each of the depth cylinders 122,122' are hydraulically coupled in parallel by use of hydraulic jumper lines 129 and each are operated in unison to raise or lower ground engaging feet 130. For purposes of brevity, the dual arrangement of cylinders 122 and 122' will hereinafter be denoted by reference numeral 122 only.

A fluid deflection device 133, preferably comprising a three-position valve, is preferably coupled with the frame 105 in a suitably selected location. Although the details of the fluid deflection device 133 will be described in greater detail as this disclosure progresses, suffice to say for now, the fluid deflection device 133 is used to divert the work machine's auxiliary fluid supply to the desired fluid cylinder 118, 121, or 122 so as to effectuate the desired movement of the tool 113. More specifically, auxiliary hydraulic fluid is communicated to the fluid deflection device 133 via auxiliary conduits 134. The auxiliary hydraulic fluid is thereafter selectively routed to either the tilt cylinder 121 via conduits 137, the side shift cylinder 118 via conduits 138, or the depth cylinder 122 via conduits 139. As should be appreciated by those of ordinary skill in such art, the primary hydraulic conduits 117 are likewise coupled to the fluid deflection device 133 via suitable branch conduits 143 and are used to selectively position, via primary hydraulic pressure, the fluid deflection device 133 to provide auxiliary hydraulic fluid to the desired fluid cylinder 118,121, or 122.

Figure 2:
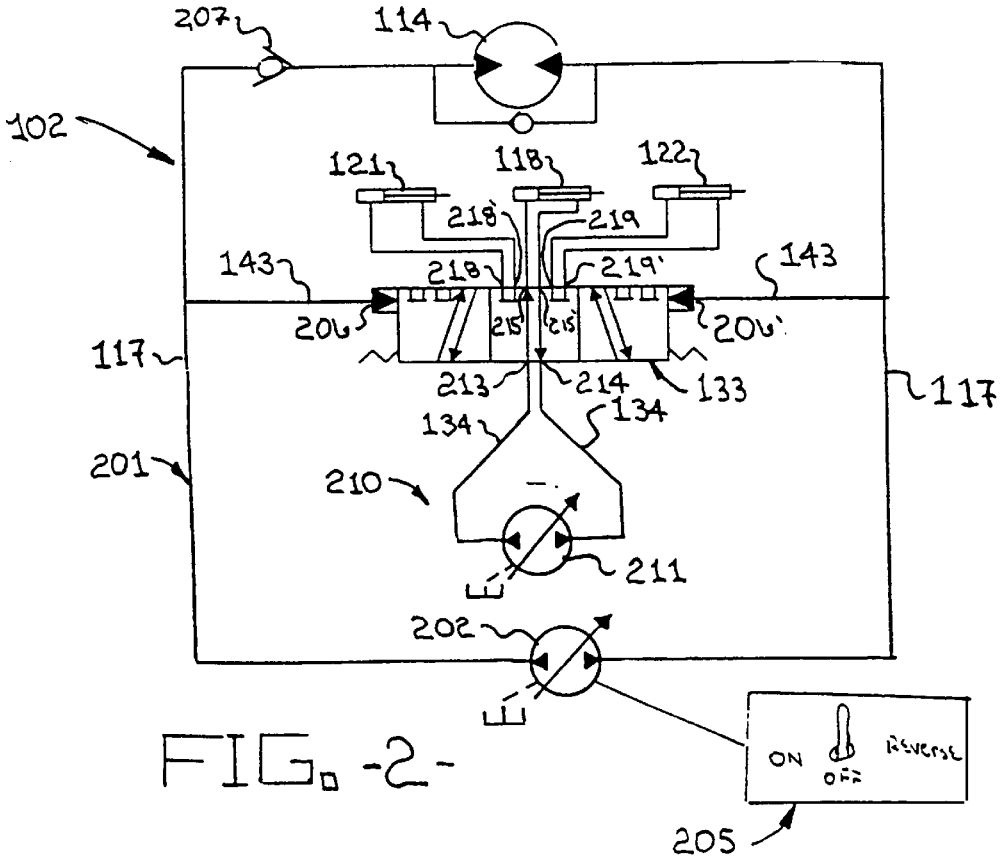
FIG. 2 is a schematic representation of the hydraulic positioning system of the present invention.

Referring now to FIG. 2, a schematic representation of a hydraulic positioning system 102 for use in the present invention is shown. The work machine's 100 primary hydraulic circuit is shown generally at 201 and includes a fluid pressure source, preferably comprising a hydraulic primary pump 202, and associated primary hydraulic conduits 117. The primary pump 202, in turn, preferably comprises a bi-directional pump which is controlled in a conventional manner from the operator's cab by use of a electrical switching mechanism 205, preferably comprising a three-position toggle switch positionable in either an "Off", "On" or "Reverse" setting. Also shown are the aforementioned branch conduits 143 used to divert primary hydraulic fluid pressure from the primary hydraulic circuit 201 to pilot control ports 206,206', provided in the fluid deflection device 133, from which the hydraulic fluid pressure is utilized to selectively control positioning of the fluid deflection device 133. A valve 207, preferably comprising a one-way check valve, may be incorporated into the primary hydraulic circuit 201 to prevent reverse rotation of the motor 114 when the aforementioned switching mechanism 205 is placed in the "Reverse" setting.

The work machine's auxiliary hydraulic circuit is shown generally at 210 and it also may include a fluid pressure source comprising a hydraulic auxiliary pump 211, preferably a bi-directional hydraulic pump, and associated auxiliary conduits 134. The auxiliary pump 211 is operated in a conventional fashion such as a toggle or button activated switch located on the operator joystick or mounted in another convenient location within the operator's cab. The fluid deflection device 133 further includes an inlet and exhaust port 213,214 for coupling in a conventional manner to the auxiliary conduits 134, and outlet ports 215,215', 218,218' and 219,219' for communicating auxiliary fluid to one of the selected respective fluid cylinders 118,121 or 122.

Figure 3:
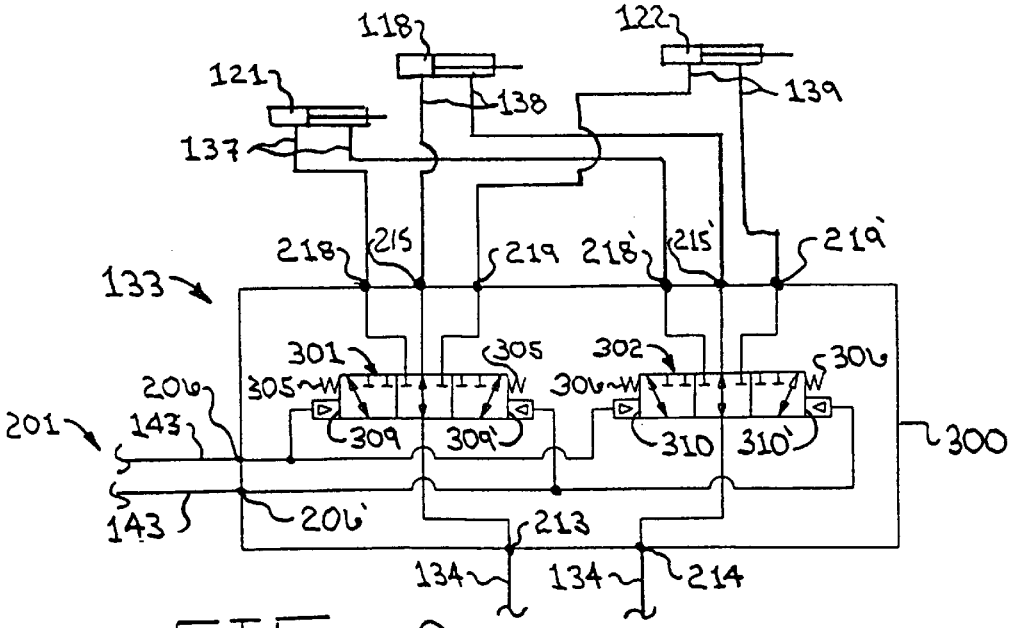
FIG. 3 is a schematic representation of a valve for use in the hydraulic positioning system of the present invention.

With reference to FIG. 3, a schematic representation of the preferred fluid deflection device 133 is shown. The fluid deflection device 133 includes a manifold or housing 300 used to house a pair of fluid deflection portions or spools 301,302. Each spool 301,302 preferably comprises a 4-way, 3-position spool each normally spring biased to a neutral position by a respective pair of centering springs 305 and 306. As shown, each spool 301,302 preferably operates in a parallel fashion when coupled to the primary hydraulic circuit 201, thereby acting in unison in the presence or absence of the primary hydraulic pressure. More specifically, each spool 301,302 is slidably situated within the housing 300 and each includes a pair of respective end portions 309,309' and 310,310'. The end portions 309,309', 310,310', in turn, are situated within chambers (not shown) which are in fluid communication with the primary hydraulic circuit 201. Activation of the primary hydraulic circuit 201 in such a manner as to cause the primary hydraulic pressure to act upon end portions 309,310 causes each spool 301,302 to shift in unison to the right, thereby diverting primary hydraulic pressure to the tilt cylinder 121. In a like manner, activation of the primary hydraulic circuit 201 in such a manner as to cause the primary hydraulic pressure to act upon end portions 309',310' causes each spool 301,302 to shift in unison to the left, thereby diverting primary hydraulic pressure to the depth cylinder 122.

INDUSTRIAL APPLICABILITY

The hydraulic control system of the present invention advantageously provides convenient means of controlling a plurality of fluid cylinders by utilizing the existing primary and auxiliary hydraulic circuits 201,210 of the work machine 100 while allowing the location of the means for switching between the fluid cylinders 118,121 or 122 to be remotely located away from the operator's cab.

In the embodiment described herein, the operator can select one of three different modes for varying the position of the tool 113 in relation the frame 105 by utilizing the primary hydraulic circuit 201 of the work machine 100 to selectively position the spools 301,302 of the fluid deflection device 133. For example, and with reference to FIG. 2, placing the switching mechanism 205 in the "Off" state deactivates the primary pump 202, thereby causing the fluid deflection device 133 to be positioned in its neutral or centered position which causes fluid to flow from the auxiliary hydraulic circuit 210 to the side shift cylinder 118. When the switching mechanism 205 is placed in the "On" or normal operating state, the primary pump 202 is activated in such a manner as to cause a leftward shift of the spools 301,302 which causes fluid to flow from the auxiliary hydraulic circuit 210 to the depth cylinder 122. Finally, placing the switching mechanism 205 in the "Reverse" mode, the primary pump 202 is activated in such a manner as to cause a rightward shift of the spools 301,302, thereby causing fluid to flow from the auxiliary hydraulic circuit 210 to the tilt cylinder 121. Upon achieving the desired position of the spools 301,302 the auxiliary pump 211 is actuated in a conventional manner to cause auxiliary fluid to flow through the fluid deflection device 133 to effectuate the desired degree of tilt, side shift or depth of the tool 113.

While this invention is susceptible to various modifications and alternate forms, a specific embodiment thereof has been shown by way of example in the drawings and described herein in detail. It should be understood, however, that there is no intent to limit the invention to the particular form disclosed, but on the contrary, the intention is to cover all modifications, equivalents, and alternatives falling within the spirit and scope of the invention as defined by the appended claims.

What is claimed is:

1. A method of operating a work machine attachment, said attachment including a frame and a tool, comprising the steps of:

providing at least a first fluid cylinder and a second fluid cylinder operatively coupling said tool with said frame;

providing a fluid deflection device having a movable fluid deflection portion;

coupling a primary hydraulic circuit to said fluid deflection device, said primary hydraulic circuit having a fluid pressure source;

coupling an auxiliary hydraulic circuit to said fluid deflection device, said auxiliary hydraulic circuit having a fluid pressure source;

activating said fluid pressure source of said primary hydraulic circuit thereby causing movement of said movable fluid deflection portion so that said first fluid cylinder is in fluid communication with said auxiliary hydraulic circuit;

activating said fluid pressure source of said auxiliary hydraulic circuit thereby causing activating of said first fluid cylinder;

reversibly activating said fluid pressure source of said primary hydraulic circuit thereby causing movement of said movable fluid deflection portion so that said second fluid cylinder is in fluid communication with said auxiliary hydraulic circuit activating said fluid pressure source of said auxiliary hydraulic circuit thereby causing activating of said fluid cylinder.

2. The method of claim 1 further comprising the step of activating said fluid pressure source of said auxiliary hydraulic circuit thereby causing activating of said first fluid cylinder.

3. An attachment for a work machine having a primary hydraulic circuit and an auxiliary hydraulic circuit, comprising;

a frame;

a tool coupled with said frame and having the ability to move with respect to a plurality of axes relative to said frame by selectively activating fluid pressure from the auxiliary hydraulic circuit;

a plurality of fluid cylinders operable to move said tool relative to said frame, at least one of said cylinders being associated with movement about each one of said axes;

a bi-directional fluid pressure source for providing fluid pressure in said primary hydraulic circuit; and a fluid deflection device having a valve and being operable to divert fluid pressure from the auxiliary hydraulic circuit to effectuate movement of the tool by a fluid cylinder with respect to an axis, said diversion of fluid occurring through the selective positioning of the valve via reversing the direction of fluid pressure in the primary hydraulic circuit acting on the valve, the direction of fluid pressure in the primary hydraulic circuit to selectively position the valve occurring when the fluid pressure source operates in one direction and movement about another of said axes occuxs when the fluid pressure source operates in the other direction.

4. The attachment of claim 3 wherein the valve includes three positions for diversion of fluid, one of said positions occurring when said fluid pressure source operates in the one direction, another of said positions occurring when said fluid pressure source operates in the other direction, and the third of said positions occurring when the fluid pressure source is de-activated.

5. The attachment of claim 3 wherein the valve is a three position hydraulic valve and diversion of fluid pressure through each of said positions effectuates movement of the tool about one of said axes.

6. The attachment of claim 5 wherein the hydraulic valve is selectively positioned in two of said positions via fluid pressure of the primary hydraulic circuit and in the third position in the absence of sufficient pressure in the primary hydraulic circuit.

7. A hydraulic positioning system for a tool movable relative to a frame with respect to at least three axes, comprising:

a primary hydraulic circuit having a pump, said pump being controllable to divert fluid pressure bi-directionally in said primary hydraulic circuit;

an auxiliary hydraulic circuit;

at least three fluid cylinders each operable to move said tool relative to said frame with respect to one of said axes by fluid pressure in said auxiliary hydraulic circuit; and a fluid deflection device coupling said fluid cylinders to the auxiliary hydraulic circuit and being selectively positionable by fluid pressure in the primary hydraulic circuit to divert fluid pressure from the auxiliary hydraulic circuit, said pressure from the auxiliary hydraulic circuit being diverted to one of said fluid cylinders when the pump of the primary hydraulic circuit is activated in one direction and of another of said fluid cylinders when the pump of the primary hydraulic circuit is activated in the other direction.

8. The hydraulic positioning system of claim 7 wherein fluid pressure from the auxiliary hydraulic circuit is diverted to the third fluid cylinder when the pump of the primary hydraulic circuit is deactivated.

9. The hydraulic positioning system of claim 7 wherein said frame is on a machine and said fluid deflection device is mounted to said frame.

10. The attachment of claim 7 wherein the fluid deflection device is a three position hydraulic valve and diversion of fluid through each of said positions effectuates movement of the tool about one of said axes.

11. The attachment of claim 10 wherein the hydraulic valve is selectively positioned in two of said positions via the pressure of the primary hydraulic circuit and in the third position in the absence of pressure in the primary hydraulic circuit.

* * * * *

UNITED STATES PATENT AND TRADEMARK OFFICE

CERTIFICATE OF CORRECTION

PATENT NO. : 6,520,593 B2 
DATED : February 18, 2003
INVENTOR(S) : Paul A. Dvorak et al.

It is certified that error appears in the above-identified patent and that said Letters Patent is hereby corrected as shown below:

Title page,
Item [56], References Cited, U.S. PATENT DOCUMENTS, "4,116,506 A * 9/1978 Moritomo et al." should be -- 4,166,506 A * 9/1979 Tezuka et al. --

Column 5,
Line 41, "occuxs" should be -- occurs --

Signed and Sealed this

Seventeenth Day of June, 2003

JAMES E. ROGAN
*Director of the United States Patent and Trademark Office*